US007861736B2

(12) United States Patent
Choi

(10) Patent No.: US 7,861,736 B2
(45) Date of Patent: Jan. 4, 2011

(54) MECHANISM FOR OPENING AND CLOSING A FOLDABLE TENT OR AWNING

(76) Inventor: Kwan Jun Choi, No. 76, Nanli, Jiyuan, Jiyuan Road, Jimei District, Xiamen, Fujian (CN)

( * ) Notice: Subject to any disclaimer, the term of this patent is extended or adjusted under 35 U.S.C. 154(b) by 0 days.

(21) Appl. No.: 12/503,168

(22) Filed: Jul. 15, 2009

(65) Prior Publication Data

US 2009/0314322 A1 Dec. 24, 2009

Related U.S. Application Data

(63) Continuation-in-part of application No. PCT/CN2007/001138, filed on Apr. 9, 2007.

(51) Int. Cl.
*E04H 15/48* (2006.01)
*E04H 15/28* (2006.01)

(52) U.S. Cl. ..... 135/143; 135/98; 135/135; 135/905

(58) Field of Classification Search ..... 135/98, 135/123, 124, 128, 135, 143, 147, 120.3, 135/901, 905, 906
See application file for complete search history.

(56) References Cited

U.S. PATENT DOCUMENTS

| | | | | |
|---|---|---|---|---|
| 5,230,358 | A * | 7/1993 | Forell | 135/98 |
| 6,021,795 | A | 2/2000 | Long et al. | |
| 6,516,823 | B1 | 2/2003 | Glover et al. | |
| 6,581,617 | B2 | 6/2003 | Ham et al. | |
| 7,607,447 | B1 * | 10/2009 | Han | 135/135 |
| 2006/0016467 | A1 * | 1/2006 | Bae | 135/98 |
| 2006/0289048 | A1 * | 12/2006 | Choi | 135/135 |
| 2007/0131265 | A1 * | 6/2007 | Choi | 135/135 |

FOREIGN PATENT DOCUMENTS

| | | | |
|---|---|---|---|
| CN | 2550449 | Y | 5/2003 |
| CN | 2828225 | Y | 10/2006 |
| CN | 2861392 | Y | 1/2007 |
| CN | 2873950 | Y | 2/2007 |
| WO | WO2006101288 | | 9/2006 |

OTHER PUBLICATIONS

1) International Search Report mailed on Jan. 17, 2008 by the ISA/CN State Intellectual Property Office in counterpart foreign application No. PCT/CN2007/001138.

* cited by examiner

*Primary Examiner*—David Dunn
*Assistant Examiner*—Danielle Jackson
(74) *Attorney, Agent, or Firm*—Abelman, Frayne & Schwab

(57) ABSTRACT

A mechanism for opening and closing a tent or awning is disclosed. A plurality of poles are pivotally attached to a hub at upper engagement points. A plurality of braces are pivotally coupled to the poles at lower engagement points at one end and pivotally coupled to a base at another end. The base has a shaft slidable in the hub and the shaft houses a biasing member which generates an upward force on the shaft which is transmitted to the braces and the poles. The upward force urges the poles to pivot toward the open position when the lower engagement point is radially outward of the upper engagement point, and the upward force urges the poles to pivot toward the closed position when the lower engagement point is radially inward of the upper engagement point.

13 Claims, 7 Drawing Sheets

MECHANISM FOR OPENING AND CLOSING A FOLDABLE TENT OR AWNING

This application is a Continuation-in-Part of PCT application No. PCT/CN2007/001138 filed 9 Apr. 2007.

BACKGROUND OF THE INVENTION

1. Field of the Invention

The present invention relates to a tent or awning, and more particularly to a mechanism for opening and closing a tent or awning.

2. Description of Prior Art

Tents or awnings are leisure apparatuses standing outdoors. Conventional big foldable tents or awnings require more operators for operating smoothly due to the bigger volume and heavier weight. So, there are a variety of roof staying mechanisms for facilitating the pitching and closing operation as their essential aims. Over the years, tents with umbrella-type collapsible frames have been developed to accommodate the user with easy opening and closing of tents but the user also encountered problems associated with failing parts, namely, failure in the locking mechanism.

So, more recently, umbrella-type tents without locking mechanisms have been developed to eliminate the concern for any potential malfunction of a locking mechanism on a tent. For example, the tent shown in U.S. Pat. No. 6,581,617 ("'617 Tent"), incorporated herein by reference, does not have a locking mechanism but is nevertheless capable of remaining open and closed. Even though the '617 Tent does not require a locking mechanism, it still has its disadvantages. First, substantial force is required to close the tent because the user must overcome the resistance generated by the lengthy spring 18. Second, the tent is much bulkier due to the length of the shank part of the rib holder 14.

OBJECTS AND SUMMARY OF THE INVENTION

The present invention solves the problems described above while maintaining the advantages of a tent which is capable of remaining open and closed without a further locking mechanism. The present invention allows a user to open and close a tent without much effort. Further, because the mechanism is compact, the tent is more convenient to store as well as for travel purposes.

In order to accomplish the above object, the present invention provides a central mechanism for opening and closing a tent or awning. The tent includes a plurality of poles each having a proximal end pivotally coupled to said central mechanism and a distal end, and movable between open and closed positions; and a plurality of braces each having a distal end pivotally coupled to the pole and a proximal end pivotally coupled to said central mechanism, and movable between open and closed positions. The central mechanism includes a base having a plurality of brace-engaging means pivotally coupled to said proximal ends of braces, respectively; a hollow shaft defined by tubular walls having upper and lower ends, said shaft extending axially upward from the base at a substantially center location of the base with the lower end of the shaft fixed to the base and the upper end of the shaft at least partially closed, the lower end of said shaft's tubular walls having cut-outs extending axially on radially opposite sides for receiving a sliding plate, said sliding plate extending radially outward and transversely through said cut-outs beyond said tubular walls for axial movement between its open and closed positions within and relative to said cut-outs; a biasing member engaging the top closure of the shaft and biasing said sliding plate downward; a hub having a central bore in which said shaft is movable axially relative to the hub, said hub having a plurality of pole-engaging means pivotally engaging said proximal ends of said poles; at least two rods, each having a top end fixed to said hub and a bottom end fixed to ends of said sliding plate, and said shaft being slidable between an open position where the biasing member is compressed and a closed position where the biasing member is less compressed, wherein a force from the biasing member in its less compressed state pushes the shaft upward relative to the hub thereby driving the braces and poles to the open position.

In operation, to open the tent, the poles are pulled away from the center of the tent or awning, at which time the biasing member located between the hub and the base expands so as to push closer the base relative to the hub. The upward force exerted by the biasing member causes an outward torque force on the poles and enables the tent to remain open without an additional locking mechanism or further external force.

Similarly, the tent or awning is closed when the operator exerts force on the poles downward so that all of the poles and braces move closer to the center of the tent or awning. The biasing member contracts as the base and hub move away from each other. The upward force exerted by the biasing member causes an inward torque force on the poles and enables the tent to remain closed without an additional locking mechanism or further external force.

Thus, the combination of the forces generated from the biasing member and the kinetics of the poles and braces not only facilitates the opening and closing of the tent or awning but also provides support such that the tent or awning is maintained in its open and closed positions without an additional locking mechanism or external force.

DETAILED DESCRIPTION OF PREFERRED EMBODIMENTS

Figure 1:
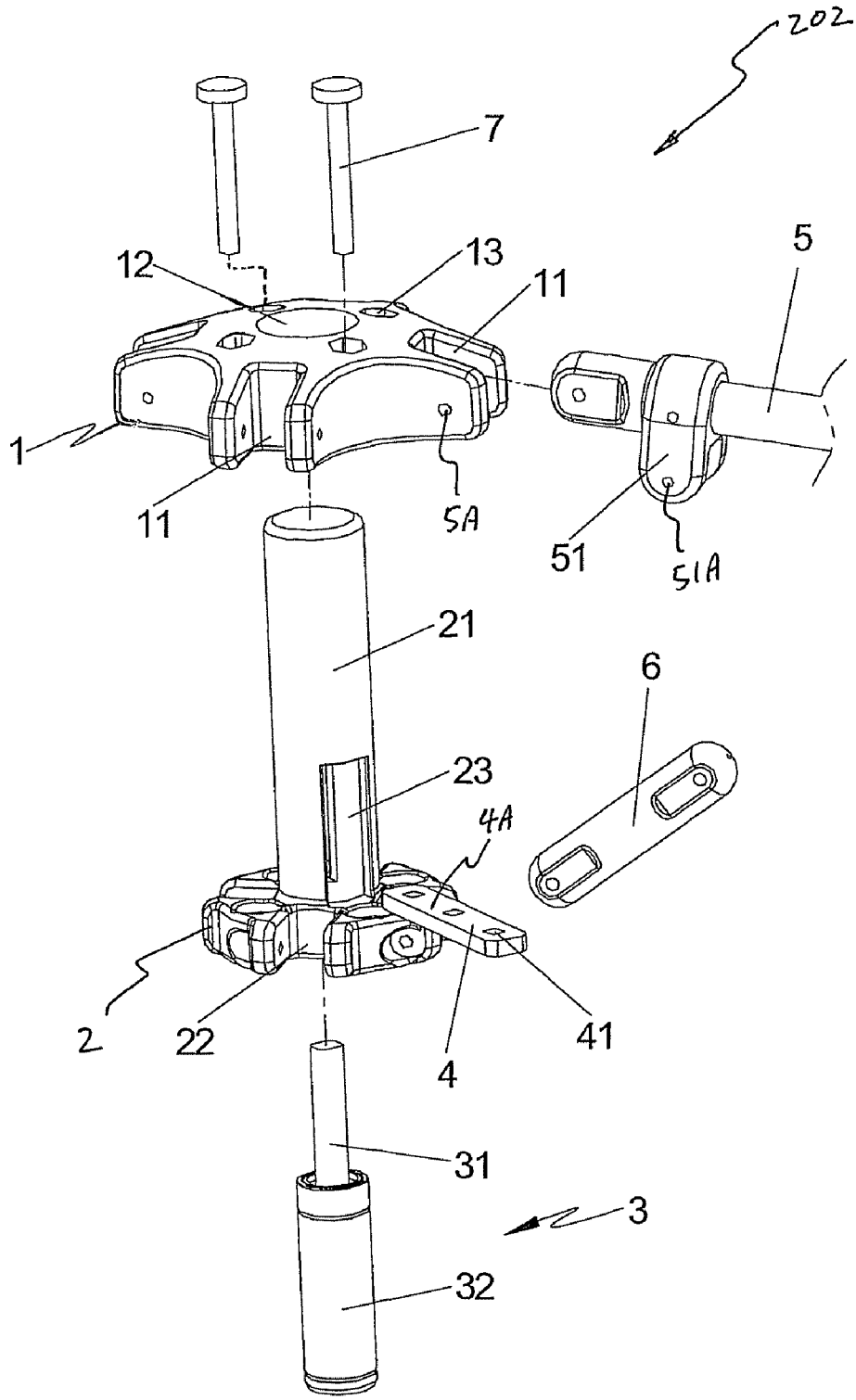
FIG. 1 is a partial exploded view showing the first embodiment of the present invention.
Figure 10:
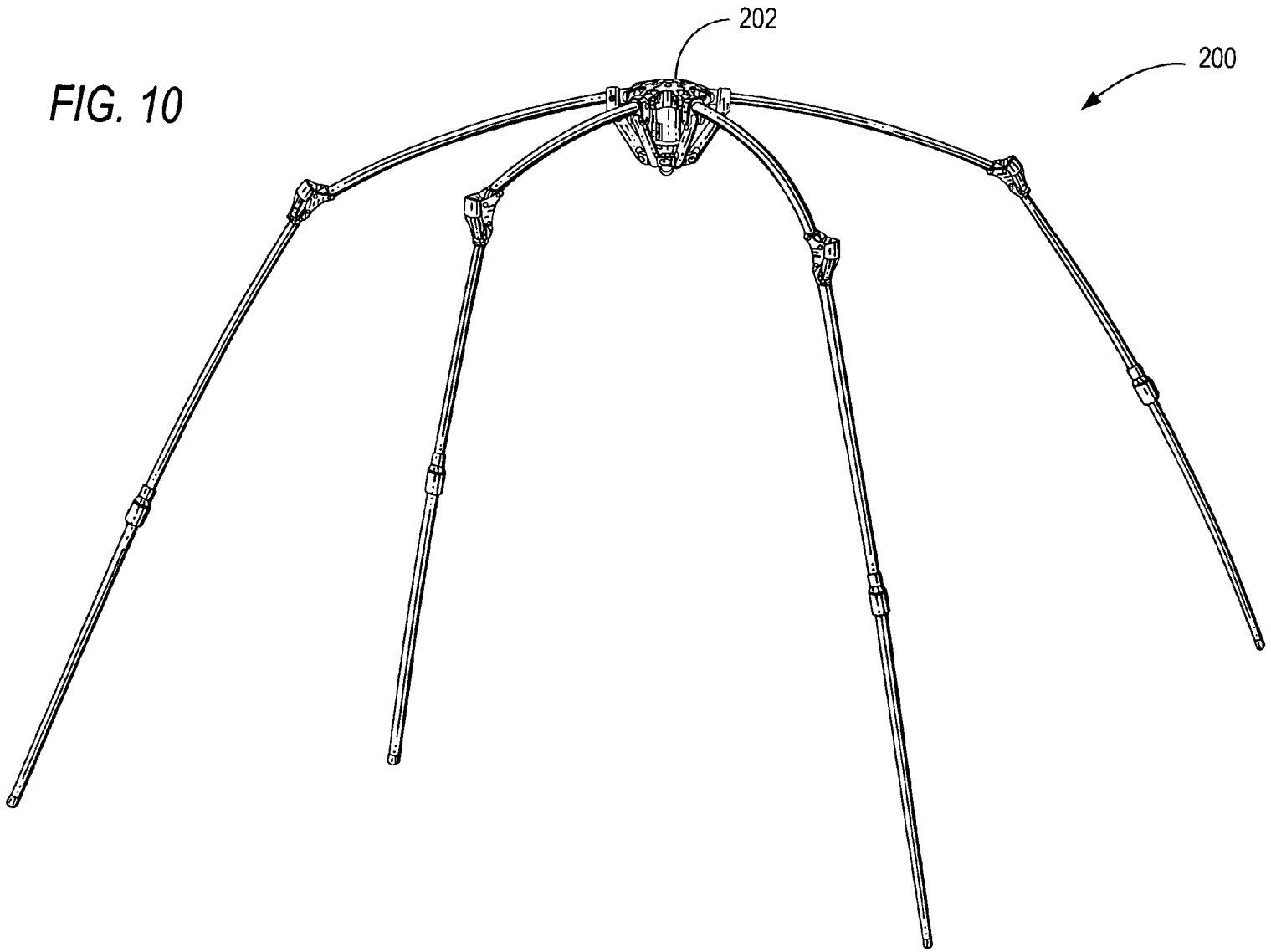
FIG. 10 is a perspective view of a foldable tent or awning with the mechanism in its open position.

A foldable tent or awning 200 having a central roof staying mechanism 202 of the present invention is shown in FIG. 10. Referring to FIG. 1, a central roof staying mechanism 202 of in the first embodiment of the present invention shown is typically comprised of a hub 1, a base 2, biasing member 3, sliding plate 4, poles 5 and braces 6.

Said hub 1 has pole slots 11 built on the four sides on the trunk respectively, a channel 12 formed on the center, and two holes 13 built on the opposite sides of the channel 12 axially.

Said base 2 has a hollow shaft 21 built on the upper portion, and brace slots 22 built respectively on the side walls of the trunk, and two opposite cut-outs 23 built on the shaft 21 from the middle portion to the bottom of the shaft 21. The shaft 21 is fully enclosed at its top distal end.

Said biasing member 3 is a bar 31 and cylinder 32 combination, with a spring or a pneumatic linear actuator placed inside of the cylinder 32 for the bar 31 to slide in and out of the cylinder 32, and in the normal configuration, said bar 31 is extended out from the inside of the cylinder 32. Alternatively, the bar 31 and cylinder 32 arrangement can be replaced with one or more springs 3 as shown in FIGS. 8 and 9.

Said sliding plate 4 is a strap matching the width of the cut-outs 23, and has axial holes 41 built on the both ends respectively.

Referring to all drawings, in combination, said biasing member 3 is placed in the hollow shaft 21, and said sliding plate 4 is positioned to extend radially outwardly into the cut-outs 23. Said sliding plate 4 is secured to the hub 1 with securing bolts 7 via holes 13 of the hub 1 and holes 41 of the sliding plate 4 so that said biasing member 3 is located in between the top surface 4A of sliding plate 4 and top end inner surface 21A of the shaft 21 extending upward from the base 2. At the same time, base 2 is positioned and axially movable in the central channel 12 of the hub 1. Four poles 5 are pivoted about upper engagement points 5A on the pole slots 11 of the hub 1 on one end, four braces 6 are pivoted respectively on the brace slots 22 of the base 2 on one end, and the other ends of the four braces 6 are individually pivoted about lower engagement points 51A on the pivoting bases 51 of the poles 5 to construct a roof staying mechanism of foldable tent or awning.

Figure 8:
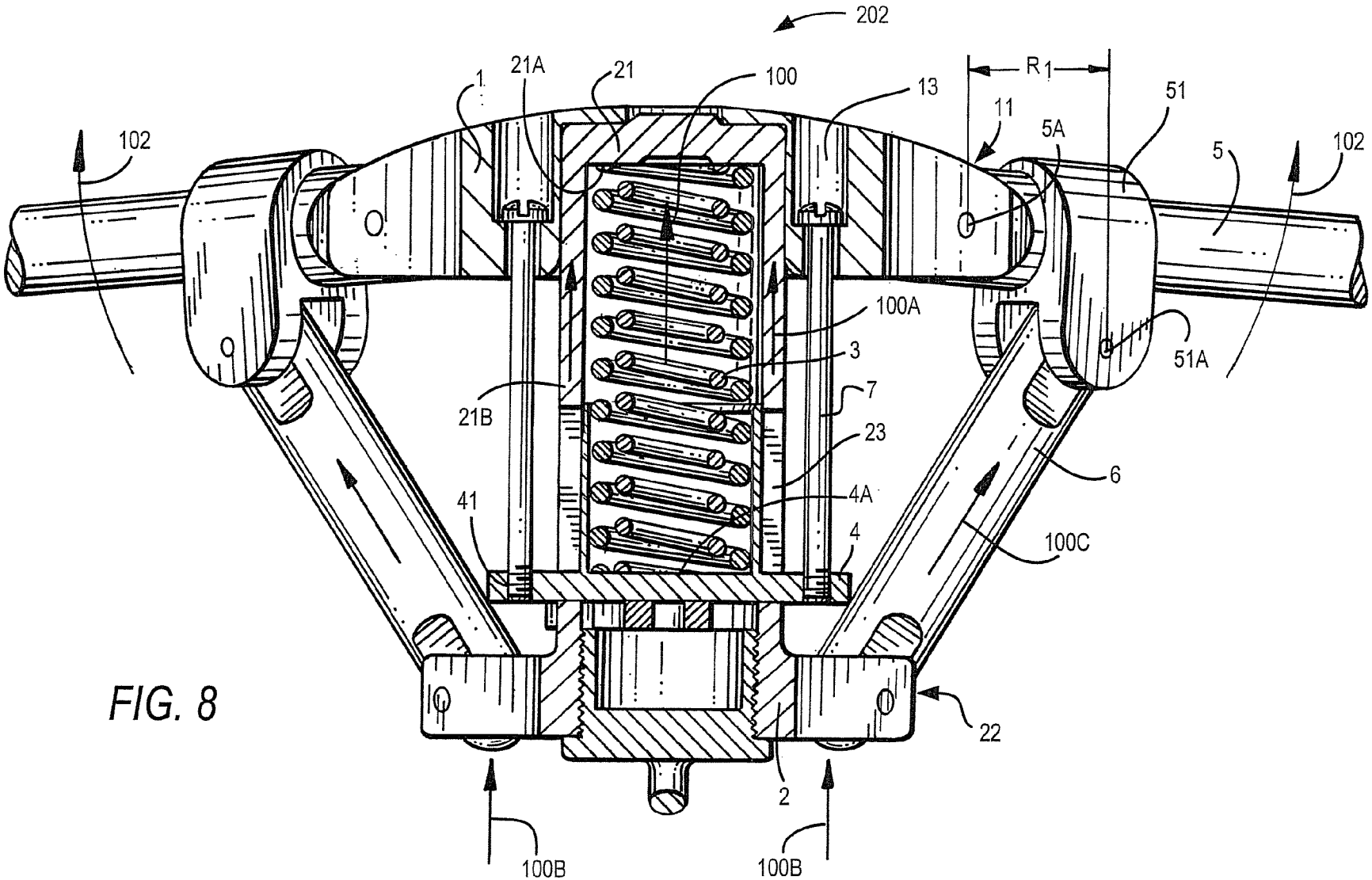
FIG. 8 is a fragmentary cross-sectional view of the third embodiment of the present invention in its open position.
Figure 9:
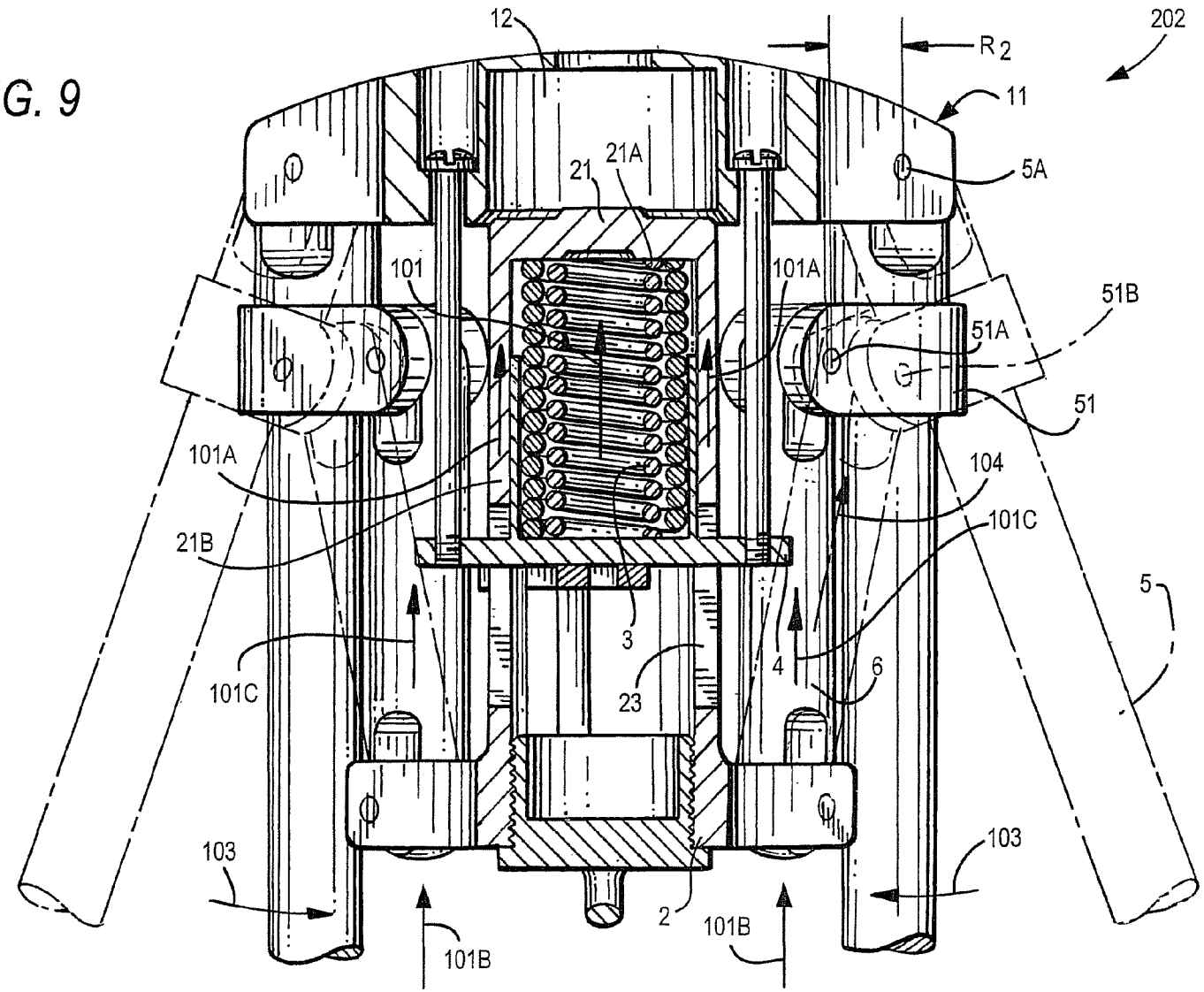
FIG. 9 is a fragmentary cross-sectional view of the third embodiment of the present invention in its closed position, with its neutral position in phantom lines.

In operation, referring to FIGS. 8 and 10, when a user wishes to open the tent or awning poles 5 are pulled away from each other which causes base 2 to be pushed upward by the biasing member 3 to approach hub 1 with the guidance of sliding plate 4 that travels downward via cut-outs 23 of shaft 21. Meanwhile, the shaft 21 moves upward through the central channel 12 of hub 1, and because braces 6 are separately pivoted between the base 2 and the poles 5, the upward movement of the base 2 causes an outward movement of the poles 5 to carry out the opening function until the tent or awning is completely opened. The combination of the forces generated by the biasing member 3 and the kinetics of the braces 6 and poles 5 causes the tent to move toward its open position and remain open without an additional external force or locking mechanism.

Specifically, referring to FIG. 8, the biasing member 3 generates an upward force 100 against the top portion of the shaft 21A which is transferred downward (force 100A) via shaft walls 21B to the base 2, which is transferred upward as force 100B into the braces 6 (force 100C) and moves into the pivoting base 51 which is fixed to and drives pole 5 upward to its open position. The upward force 100C on the poles 5 generates an outward torque force 102 on the poles 5 and causes the poles 5 and braces 6 to remain extended outward in its open position. This outward torque force 102 on the poles 5 is generated from the force 100C on the braces 6 in combination with the moment arm R1 created by the distance between upper engagement point 5A and lower engagement point 51A.

Referring to the phantom lines in FIG. 9, the mechanism has a neutral position where the poles 5 have a tendency to move to either its open or closed positions. In the neutral position, no torque force is present on the poles 5 despite the force 104 on the braces 6 because no moment arm exists. This is because the upper engagement point 5A and lower engagement point 51B are vertically aligned.

Referring to FIG. 9, when a user wishes to close the tent or awning, the user pushes all the poles 5 downward and inward tending to bring them closer together and parallel to the shaft 21, which also causes the braces 6 to move closer to an orientation that is parallel to the shaft 21. At this time, the sliding plate 4 moves up to the top ends of the cut-outs 23 as the biasing member 3 is compressed. The combination of the forces generated by the biasing member 3 and the kinetics of the braces 6 and poles 5 causes the poles 5 and braces 6 to move toward their closed position and remain closed without an additional external force or locking mechanism.

More specifically, the biasing member 3 generates an upward force 101 against the top portion of the shaft 21A which is transferred downward (force 101A) via shaft walls 21B to the base 2, which is transferred upward as force 101B into the braces 6 (force 101C) and moves into the pivoting base 51 which is fixed to and drives pole 5 downward and inward to its closed position. The upward force 101C on the poles 5 generates an inward torque force 103 on the poles 5 and causes the poles 5 and braces 6 to remain substantially vertical and in its closed position.

This inward torque force 103 on the poles 5 is generated from the force 101C on the braces 6 in combination with the moment arm R2 created by the distance between upper engagement point 5A and lower engagement point 51A.

Figure 2:
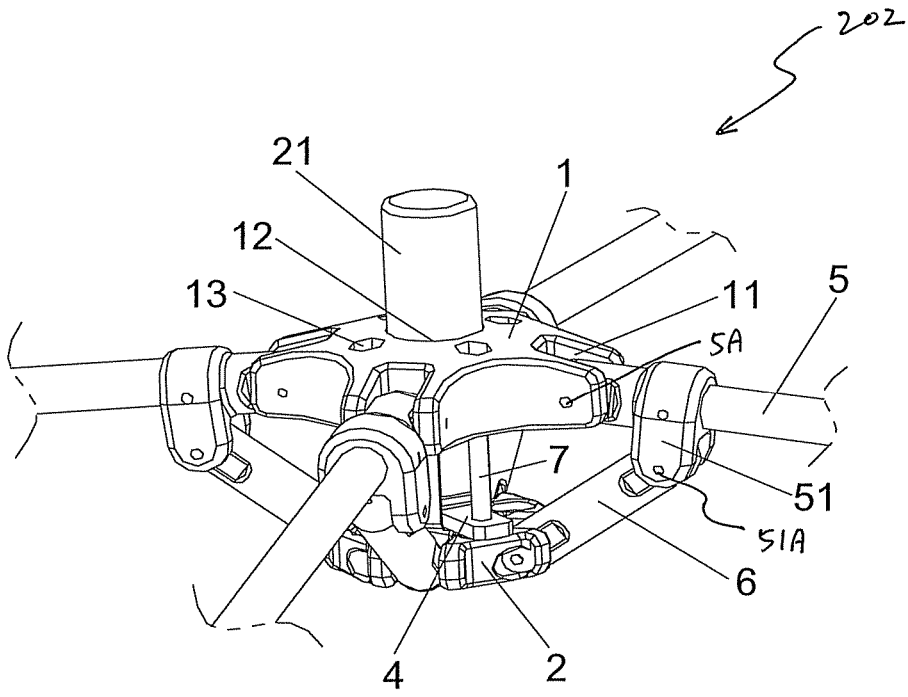
FIG. 2 is a perspective view showing the open configuration of the first embodiment of the present invention.
Figure 3:
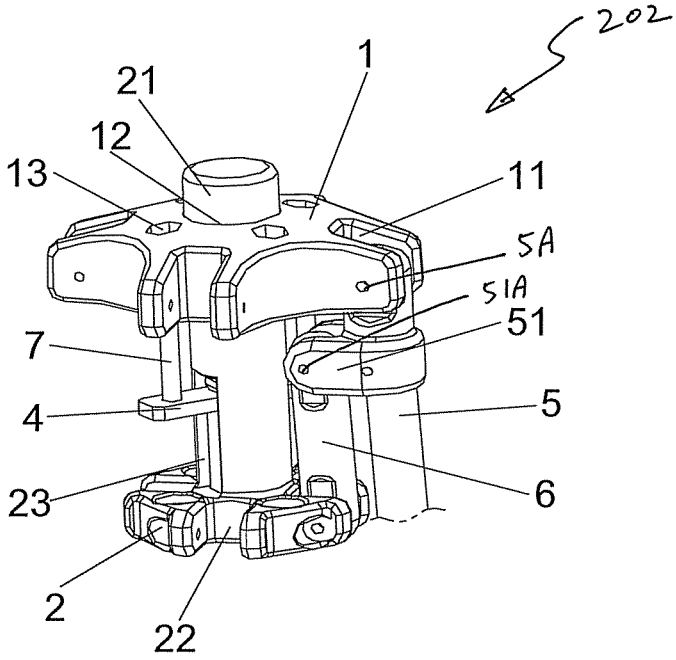
FIG. 3 is a partial perspective view showing the closed configuration of the first embodiment of the present invention.

Referring to FIGS. 2 and 3, in the first embodiment, the mechanism 202 moves from its open position (FIG. 2) to its closed position (FIG. 3) when the sliding plate 4 moves up to the top end of the cut-outs 23 of the shaft 21 to shorten the exposed upper portion of the shaft 21 protruding above the hub 1 as the biasing member 3 is compressed to create potential energy from the subsequent opening phase.

Figure 4:
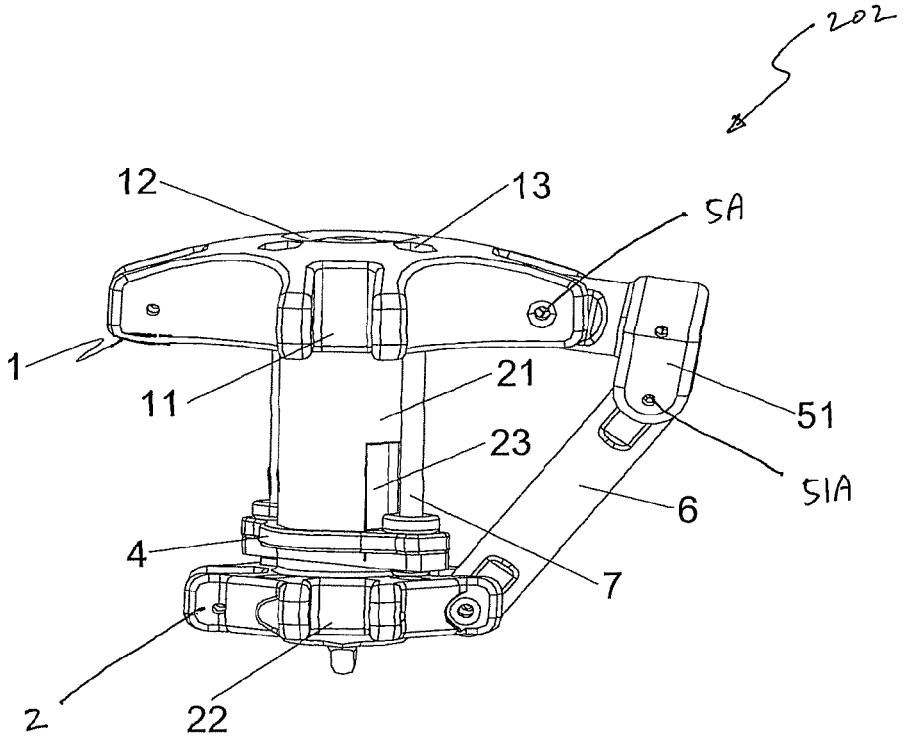
FIG. 4 is a partial side view showing the open configuration of the second embodiment of the present invention.
Figure 5:
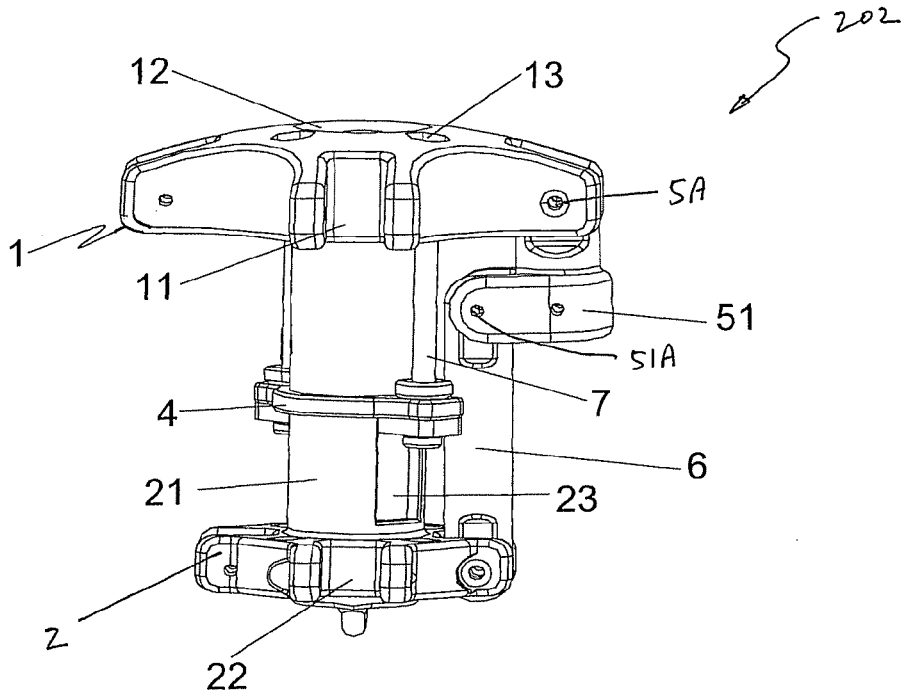
FIG. 5 is a partial side view showing the closed configuration of the second embodiment of the present invention.
Figure 6:
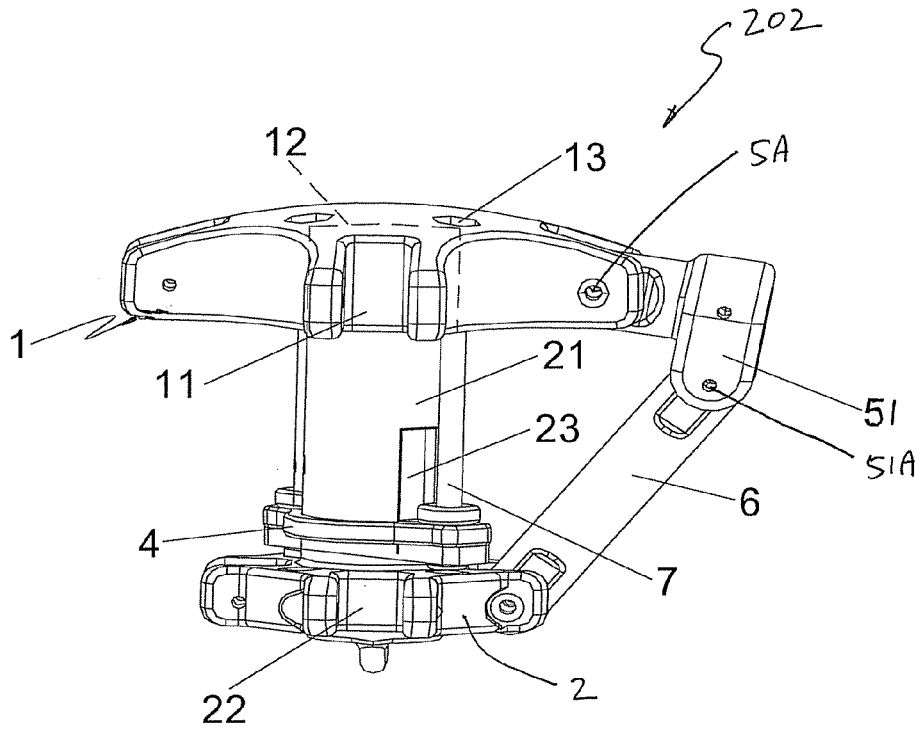
FIG. 6 is a partial side view showing the open configuration of the third embodiment of the present invention.
Figure 7:
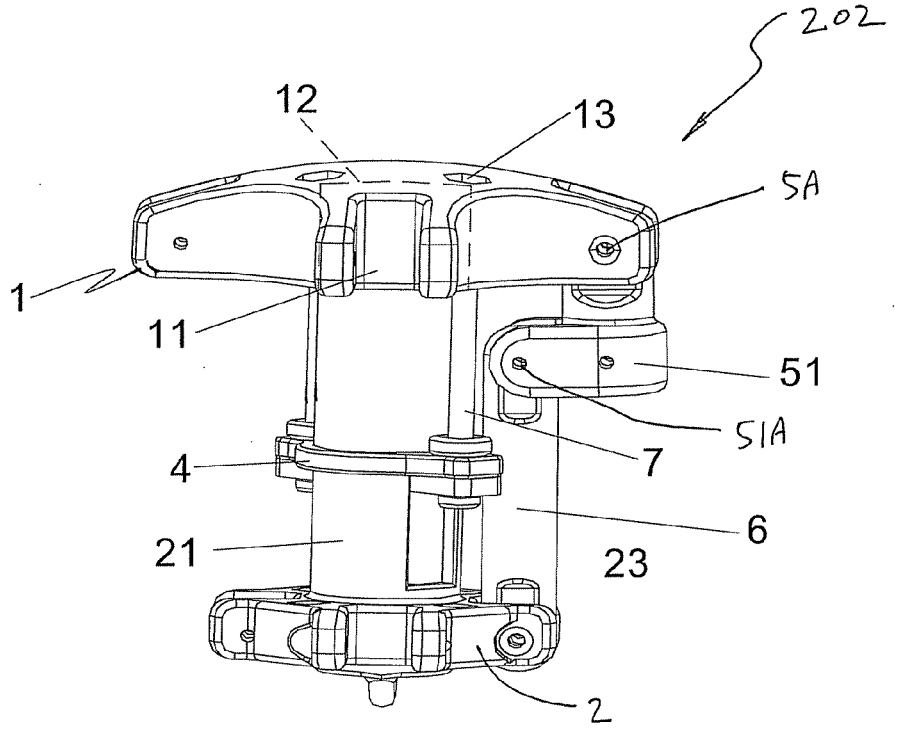
FIG. 7 is a partial side view showing the closed configuration of the third embodiment of the present invention.

Referring to FIGS. 4 and 5, a roof staying mechanism 202 of foldable tent or awning 200 in the second embodiment of the present invention is shown. The difference between the first and second embodiments is that the length of the shaft 21 is such that the top end of the shaft 21 in its open and closed positions remains within the channel 12.

Referring to FIGS. 6-9, a roof staying mechanism 202 of foldable tent or awning 200 in the third embodiment of the present invention is shown. In this embodiment, a blind hole 12 opened downward takes the place of the channel 12 in the first embodiment. In operation, the sliding distance of the shaft 21 of the base 2 in the hub 1 is substantially equal in depth of the blind hole 12. The blind hole 12 is completely enclosed at the top and therefore, any water deposition or dust-stratification can be avoided without affecting the opening and closing operation of the tent or awning.

The present invention solves a number of problems that are present in the prior art. The present invention makes it possible for a user to pitch and fold a tent or awning on her own. This is due to the simple construction and relatively light resistance of the biasing member of the roof staying mechanism. Further, the user does not require assistance because the motion of the mechanism is fairly limited when pitching or closing the tent or awning.

The present invention also allows for a foldable tent or awning to be more light-weight and easily stored. This is because the mechanism in the present invention is more compact than those of the prior art due to the short length of the biasing member.

Finally, the invention does not require additional locking mechanisms to maintain the tent or awning in an open or closed position. The combination of the forces generated by the biasing member 3 and the kinetics of the braces 6 and poles 5—more specifically, the torque forces 102, 103 created by the biasing member 3 in combination with moment arms R1 and R2—causes the tent to remain open and closed without an additional locking mechanism or further external force. Given that locking mechanisms frequently malfunction or fail, the potential of such problems are eliminated.

While the above description contains many specificities, these should not be construed as limitations on the scope of the invention, but rather as an exemplification of preferred embodiments thereof. Many other variations are possible such as, for example, the mechanism could have three poles instead of four and act as a tripod for various uses. Accordingly, the scope of the invention should be determined not by the embodiments illustrated, but by the appended claims and their legal equivalents.

I claim:

1. A central mechanism for opening and closing a tent or awning, said tent or awning including:

a plurality of poles each having a proximal end pivotally coupled to said central mechanism and a distal end, and movable between open and closed positions, a plurality of braces each having a distal end pivotally coupled to the pole and a proximal end pivotally coupled to said central mechanism, and movable between open and closed positions, said central mechanism including:

a base having a plurality of brace-engaging means pivotally coupled to said proximal ends of braces, respectively, a hollow shaft defined by tubular walls having upper and lower ends, said shaft extending axially upward from the base at a substantially center location of the base with the lower end of the shaft fixed to the base and the upper end of the shaft at least partially closed, the lower end of said shaft's tubular walls having cut-outs extending axially on radially opposite sides for receiving a sliding plate, said sliding plate extending radially outward and transversely through said cut-outs beyond said tubular walls for axial movement between its open and closed positions within and relative to said cut-outs, a biasing member engaging the top closure of the shaft and biasing said sliding plate downward, a hub having a central bore in which said shaft is movable axially relative to the hub, said hub having a plurality of pole-engaging means pivotally engaging said proximal ends of said poles, at least two rods, each having a top end fixed to said hub and a bottom end fixed to ends of said sliding plate, and said shaft being slidable between an open position where the biasing member is compressed and a closed position where the biasing member is less compressed, wherein a force from the biasing member in its less compressed state pushes the shaft upward relative to the hub thereby driving the braces and poles to the open position.

2. The central mechanism in claim 1, wherein the hub has holes extending axially to receive the rods.

3. The central mechanism in claim 1, wherein the base has at least three brace-engaging means.

4. The central mechanism in claim 1, wherein the hub has at least three pole-engaging means.

5. The central mechanism in claim 1, wherein the central bore is enclosed at a top portion of the hub.

6. The central mechanism in claim 1, wherein the biasing member is selected from a group comprising a spring, a compressed air chamber or a pneumatic linear actuator.

7. A mechanism for opening and closing a tent or awning comprising:

a plurality of poles each having a proximal end and a distal end, a plurality of braces each having a proximal end and a distal end, said distal ends of braces pivotally coupled to said poles, a base having a hollow shaft extending axially upward, said base pivotally coupled to said proximal ends of braces, said shaft having a top end and bottom end and having cut-outs extending axially for receiving a sliding plate, said sliding plate extending radially within said shaft for axial movement between open and closed positions, a biasing member engaging the top of the shaft and biasing said sliding plate downward, and a hub having a central bore in which said shaft is movable axially relative to the hub, said hub coupled to said sliding plate and pivotally engaging said proximal ends of said poles.

8. The mechanism in claim 7, wherein the shaft is slidable between an open position where the biasing member is compressed and a closed position where the biasing member is less compressed.

9. The mechanism in claim 8, wherein a force from the biasing member in its less compressed state pushes the shaft upward relative to the hub thereby driving the braces and poles to the open position.

10. The mechanism in claim 8, wherein a force from the biasing member in its compressed state pushes the shaft upward relative to the hub thereby driving the braces and poles to the closed position.

11. A mechanism for opening and closing a tent or awning comprising:

a plurality of poles each having a proximal end and a distal end, and movable between open and closed positions, said proximal ends of the poles pivotally attached to a hub at upper engagement points, a plurality of braces each having a proximal end and a distal end, and movable between open and closed positions, said proximal ends of braces pivotally coupled to the poles at lower engagement points and said distal ends of braces pivotally coupled to a base, said base having a shaft slidable in the hub, a biasing member inside the shaft generates an upward force which at all times urges the shaft upward relative to the hub, the upward force on the shaft is transmitted to the braces, the braces then at all times having an upward force, wherein the upward force in the braces when applied to the poles urges the poles to pivot toward the open position when the lower engagement point is radially outward of the upper engagement point, and the upward force in the braces when applied to the poles urges the poles to pivot toward the closed position when the lower engagement point is radially inward of the upper engagement point.

12. The mechanism in claim 11, wherein the upward force on the braces generates an outward force on the poles when the lower engagement point is radially outward relative to the upper engagement point.

13. The mechanism in claim 11, wherein the upward force on the braces generates an inward force on the poles when the lower engagement point is radially inward relative to the upper engagement point.

* * * * *

UNITED STATES PATENT AND TRADEMARK OFFICE

CERTIFICATE OF CORRECTION

PATENT NO. : 7,861,736 B2
APPLICATION NO. : 12/503168
DATED : January 4, 2011
INVENTOR(S) : Kwan Jun Choi It is certified that error appears in the above-identified patent and that said Letters Patent is hereby corrected as shown below:

Column 2, lines 10 and 11, “less”, each occurence, should read --more--.
Column 4, line 34, “from” should read --for--.

In the Claims:
Claim 1 - Column 5, lines 49 and 50, “less”, each occurence, should read --more--.
Claim 8 - Column 6, line 22, “less” should read --more--.
Claim 9 - Column 6, line 24, “less” should read --more--.
Claim 10 - Column 6, line 29, “upward” should read --downward--.

Signed and Sealed this
Twenty-eighth Day of February, 2012

David J. Kappos

David J. Kappos
*Director of the United States Patent and Trademark Office*